US009285145B2

(12) United States Patent
Gao et al.

(10) Patent No.: US 9,285,145 B2
(45) Date of Patent: Mar. 15, 2016

(54) EVAPORATOR AND REFRIGERATION SYSTEM COMPRISING THE SAME

(75) Inventors: Qiang Gao, Hangzhou (CN); Yanxing Li, Hangzhou (CN)

(73) Assignee: SANHUA (HANGZHOU) MICRO CHANNEL HEAT EXCHANGE CO., LTD., Nordborg (DK)

( * ) Notice: Subject to any disclaimer, the term of this patent is extended or adjusted under 35 U.S.C. 154(b) by 196 days.

(21) Appl. No.: 13/883,570

(22) PCT Filed: Dec. 24, 2010

(86) PCT No.: PCT/CN2010/080259

§ 371 (c)(1),
(2), (4) Date: Jul. 18, 2013

(87) PCT Pub. No.: WO2012/058844

PCT Pub. Date: May 10, 2012

(65) Prior Publication Data

US 2013/0291579 A1 Nov. 7, 2013

(30) Foreign Application Priority Data

Nov. 4, 2010 (CN) ..... 2010 1 0538204

(51) Int. Cl.
*F25B 47/00* (2006.01)
*F25D 21/00* (2006.01)
(Continued)

(52) U.S. Cl.
CPC ..... *F25B 39/02* (2013.01); *F25B 47/025* (2013.01); *F28D 1/05316* (2013.01);
(Continued)

(58) Field of Classification Search
CPC ..... F25B 2313/02322; F25B 2347/02; F25B 47/006; F25B 47/02; F25B 47/022; F25B 47/025; F25B 2313/02741; F25D 21/06
USPC ..... 62/278, 80–81, 272, 277, 324.5, 62/509–510, 150–151
See application file for complete search history.

(56) References Cited

U.S. PATENT DOCUMENTS 2,678,545 A * 5/1954 Zearfoss, Jr. ..... F25B 47/022 62/197
4,122,686 A * 10/1978 Lindahl et al. ..... 62/81
4,313,313 A * 2/1982 Chrostowski et al. ..... 62/278
7,104,079 B2 * 9/2006 Kuwabara ..... F25B 6/04 62/234

(Continued)

FOREIGN PATENT DOCUMENTS

CN 87105945 A 7/1988
CN 1164013 A 11/1997

(Continued)

OTHER PUBLICATIONS

International Search Report PCT/CN2010/080259 dated Aug. 18, 2011.

*Primary Examiner* — Frantz Jules
*Assistant Examiner* — Steve Tanenbaum
(74) *Attorney, Agent, or Firm* — Howard & Howard Attorneys PLLC

(57) ABSTRACT

An evaporator (500) comprises a first header (501) defining one end formed with a first refrigerant port (5010), a second header (502) defining one end formed with a second refrigerant port (5020), heat-exchange tubes (503) each connected between the headers (501, 502) to communicate the headers (501, 502), fins (504) respectively interposed between adjacent heat-exchange tubes (503), and a defrosting tube (505) defining a first end connected to one of the headers (501, 502) to communicate with an interior of the one header. A position of the first end of the defrosting tube (505) is spaced apart from the one end of the one header by a predetermined distance. A refrigeration system comprises the evaporator. By providing the defrosting tube (505), defrosting speed is increased, defrosting time is shortened, and energy efficiency of the refrigeration system is improved.

9 Claims, 8 Drawing Sheets

(51) Int. Cl.

| | |
|---|---|
| ***F25B 41/00*** | (2006.01) |
| ***F25B 13/00*** | (2006.01) |
| ***F25B 39/04*** | (2006.01) |
| ***F25B 1/10*** | (2006.01) |
| ***F25B 39/02*** | (2006.01) |
| ***F28D 1/053*** | (2006.01) |
| ***F28F 9/02*** | (2006.01) |
| ***F28F 17/00*** | (2006.01) |
| ***F28F 19/00*** | (2006.01) |
| *F25B 47/02* | (2006.01) |
| *F25D 21/06* | (2006.01) |
| *F28D 21/00* | (2006.01) |

(52) U.S. Cl.

CPC ..... *F28F 9/0273* (2013.01); *F28F 17/00* (2013.01); *F28F 19/006* (2013.01); *F25B 47/006* (2013.01); *F25B 47/02* (2013.01); *F25B 47/022* (2013.01); *F25B 2313/02322* (2013.01); *F25B 2347/02* (2013.01); *F25D 21/06* (2013.01); *F28D 2021/0071* (2013.01); *F28D 2021/0085* (2013.01)

(56) References Cited

U.S. PATENT DOCUMENTS

| | | | | |
|---|---|---|---|---|
| 7,171,817 | B2 * | 2/2007 | Birgen | F25B 13/00 62/140 |
| 2011/0203780 | A1 * | 8/2011 | Jiang | F28D 1/05366 165/173 |

FOREIGN PATENT DOCUMENTS

| | | | |
|---|---|---|---|
| CN | 1535311 | A | 10/2004 |
| CN | 101839590 | A | 9/2010 |
| EP | 1108575 | A1 | 6/2001 |
| JP | 10300271 | | 11/1998 |

* cited by examiner

EVAPORATOR AND REFRIGERATION SYSTEM COMPRISING THE SAME

CROSS-REFERENCE TO RELATED APPLICATIONS

This is a "national phase" application of International Patent Application PCT/CN2010/080259 filed on Dec. 24, 2010, which, in turn, is based upon and claims priority to Chinese Patent Application 201010538204.2 filed Nov. 4, 2010.

BACKGROUND OF INVENTION

1. Field of Invention

The invention relates to, in general, refrigeration and, more particularly, an evaporator and a refrigeration system comprising the evaporator.

2. Description of Related Art

When a refrigeration system, such as the refrigeration system of an air conditioner, is operated in winter and the ambient temperature is very low, the evaporating temperature of the evaporator will be less than zero degrees, and, consequently, the refrigeration system needs to be defrosted. With the conventional refrigeration system, full reverse circulation is used for defrosting; that is, the condenser is used as an evaporator, and the evaporator is used as a condenser.

With the conventional refrigeration system, when defrosting is performed, the indoor ambient temperature will be reduced, thus causing comfort degree to be reduced. On the other hand, defrosting will cause indoor-environment-heat supply to be broken off, thus reducing the energy efficiency of the system.

In addition, because refrigerant guide pipes are usually disposed within the inlet header and the outlet header of the evaporator, during defrosting, the flow resistance of the refrigerant is very large, and the refrigerant may not pass through the evaporator in large quantities rapidly such that the defrosting speed is low. In the refrigeration system using a refrigerant (for example, R407C with large temperature glide), because the frosted position is usually adjacent to the refrigerant inlet of the heat exchanger, defrosting may not be rapidly performed by "reverse-circulation defrosting" mode of introducing the gaseous refrigerant from the outlet header such that the defrosting time is long and the operating efficiency of the system is low.

SUMMARY OF INVENTION

Embodiments of the invention seek to solve at least one of the problems existing in the related art to at least some extent. Accordingly, an evaporator is provided by which the defrosting time is short, the defrosting speed is high, and the operation efficiency is improved. Further, a refrigeration system comprising the above-mentioned evaporator is provided, which may reduce the fluctuation of indoor temperature.

More specifically, the invention overcomes the disadvantages in the related art in a evaporator comprising a first header defining one end formed with a first refrigerant port. A second header defines one end formed with a second refrigerant port. Each of a plurality of heat-exchange tubes is connected between the first and second headers to communicate the first and second headers. A plurality of fins are respectively interposed between adjacent heat-exchange tubes. A defrosting tube defines a first end connected to one of the first and second headers to communicate with an interior of the one header. A position of the first end of the defrosting tube is spaced apart from the one end of the one header by a predetermined distance.

With the evaporator according to embodiments of the invention, because the defrosting tube is connected to the first or second header, when the evaporator needs to be defrosted, the refrigerant enters into the first or second header from the defrosting tube, thus increasing the defrosting speed, shortening the defrosting time, and improving the energy efficiency of the refrigeration system.

In an embodiment, the first end of the defrosting tube is connected to a middle portion of the one header.

In an embodiment, an angle between an axis of the defrosting tube and an axis of each heat-exchange tube is between about 45 degrees and about 315 degrees.

In an embodiment, the predetermined distance is greater than about 100 millimeters.

In an embodiment, the one header is formed with a refrigerant guide tube having an open end and a closed end and formed with a plurality of openings, the open end of the refrigerant guide tube extending out from a refrigerant port of the one header.

The invention overcomes the disadvantages in the related art also in a refrigeration system comprising the evaporator and a compressor. A four-way valve defines first to fourth valve ports. The first and third valve ports are connected to the compressor. A condenser defines an inlet connected to the second valve port. A throttle mechanism defines an inlet connected to an outlet of the condenser. The evaporator is connected between the fourth valve port and an outlet of the throttle mechanism. A refrigerant switching unit is connected to the evaporator between the fourth valve port and the outlet of the throttle mechanism and allows a refrigerant to enter into the first header from the four-way valve through the throttle mechanism and flow out of the second header to return to the four-way valve when the refrigeration system is in a "normal operation" mode and the refrigerant to enter into the one header from the four-way valve through the defrosting tube and flow out of the other of the first and second headers to return to the four-way valve through the throttle mechanism when the refrigeration system is in a "defrosting operation" mode.

In an embodiment, the refrigerant switching unit includes first to fourth valves, the first valve is connected between the fourth valve port of the four-way valve and the second refrigerant port of the second header, a first side of the second valve is connected between the first valve and the second refrigerant port of the second header, a second side of the second valve is connected to the throttle mechanism, a first side of the third valve is connected between the second side of the second valve and the throttle mechanism, a second side of the third valve is connected to the first refrigerant port of the first header, and the fourth valve is connected between the fourth valve port of the four-way valve and a second end of the defrosting tube.

In an embodiment, the first end of the defrosting tube is connected to the first header or the second header.

In an embodiment, the first end of the defrosting tube is connected to the second header, and the refrigerant switching unit includes a first valve connected between the fourth valve port of the four-way valve and the second refrigerant port of the second header and a fourth valve connected between the fourth valve port of the four-way valve and a second end of the defrosting tube.

In an embodiment, the first end of the defrosting tube is connected to the second header, a second end of the defrosting tube is connected to the fourth valve port of the four-way valve, and the refrigerant switching unit includes a first valve connected between the fourth valve port of the four-way valve and the second refrigerant port of the second header.

Other objects, features, and advantages of the invention are readily appreciated as the invention becomes better understood while a subsequent detailed description of embodiments of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Figure 1:
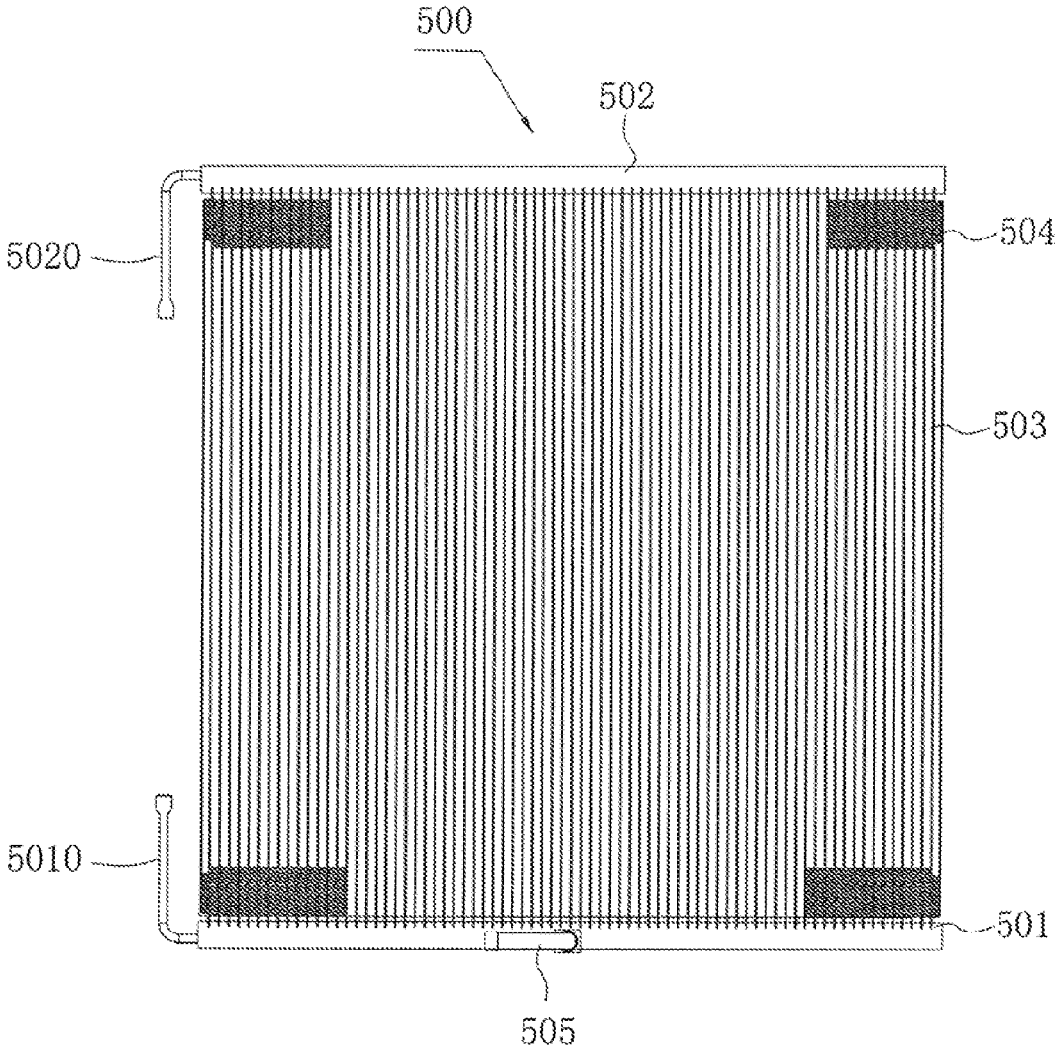
FIG. 1 is a plan view of an evaporator according to an embodiment of the invention.

Embodiments of the invention will be described in detail in the following descriptions examples of which are shown in the accompanying drawing, wherein the same or similar elements and elements having same or similar functions are denoted by like reference numerals throughout the descriptions. The embodiments described herein with reference to the accompanying drawing are explanatory and illustrative, which are used to generally understand the invention. The embodiments shall not be construed to limit the invention.

It is to be understood that phraseology and terminology used herein with reference to device or element orientation (terms like "longitudinal," "lateral," "front," "rear," "right," "left," "lower," "upper," "horizontal," "vertical," "above," "below," "up," "top," and "bottom" as well as derivatives thereof such as "horizontally," "downwardly," "upwardly," etc.) are only used to simplify description of the invention and do not alone indicate or imply that the device or element referred to must have or be operated in a particular orientation.

Terms concerning attachments, coupling, and the like, such as "connected" and "interconnected," refer to a relationship in which structures are secured or attached to one another either directly or indirectly through intervening structures as well as both movable or rigid attachments or relationships, unless expressly described otherwise. In addition, terms such as "first" and "second" are used herein for purposes of description and are not intended to indicate or imply relative importance or significance.

The evaporator 500 according to embodiments of the invention will be described below with reference to the drawing.

The evaporator 500 according to embodiments of the invention comprises a first header 501, a second header 502, a plurality of heat-exchange tubes 503, a plurality of fins 504, and a defrosting tube 505.

One end of the first header 501 is formed with a first refrigerant port 5010, and one end of the second header 502 is formed with a second refrigerant port 5020.

For convenience, in the following description, the first header 501 is used as the inlet header of the evaporator 500, the second header 502 is used as the outlet header of the evaporator 500, the first refrigerant port 5010 is used as the refrigerant inlet of the evaporator 500, the second refrigerant port 5020 is used as the refrigerant outlet of the evaporator 500, and the first refrigerant port 5010 and the second refrigerant port 5020 are the refrigerant inlet pipe and the refrigerant outlet pipe, respectively.

Each heat-exchange tube 503, such as a flat tube, is connected between the first and second headers 501, 502 to communicate the first and second headers 501, 502.

The plurality of fins 504 are interposed between adjacent heat-exchange tubes 503, respectively. A first end of the defrosting tube 505 is connected to one header of the first and second headers 501, 502 to communicate with an interior of the one header, wherein a position of the first end of the defrosting tube 505 connected to the one header is spaced apart from the one end of the one header formed with the refrigerant port by a predetermined distance.

Figure 2:
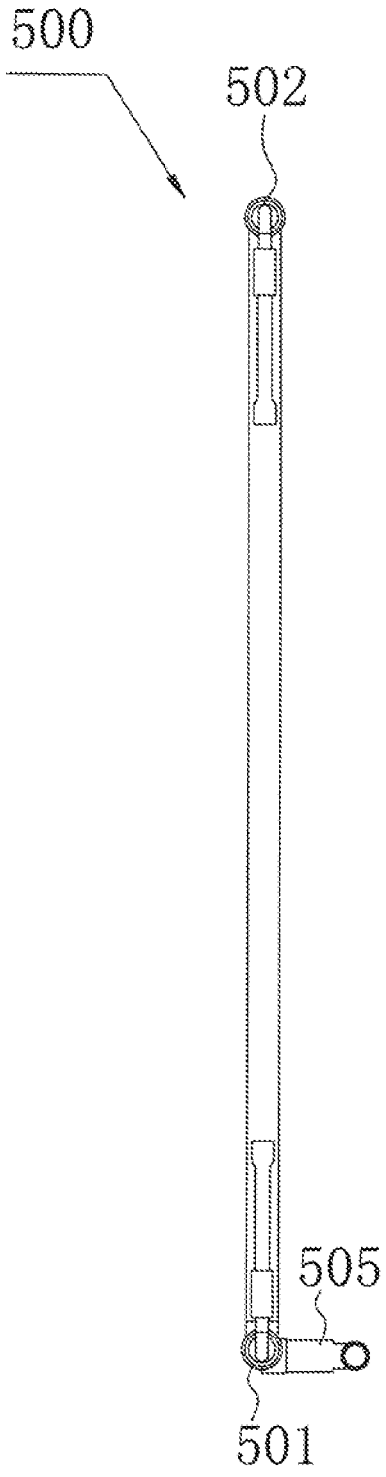
FIG. 2 is a side view of the evaporator shown in FIG. 1.

The evaporator 500 according to embodiments of the invention will be described below with reference to FIGS. 1-2. As shown in FIGS. 1-2, the defrosting tube 505 is connected to the inlet header 501. More particularly, the first end of the defrosting tube 505 is connected to a substantially middle portion of the inlet header 501. An angle between the axis of the defrosting tube 505 and the axis (i.e., the "length" direction of each heat-exchange tube 503) of each heat-exchange tube 503 is substantially about 90 degrees.

Figure 3:
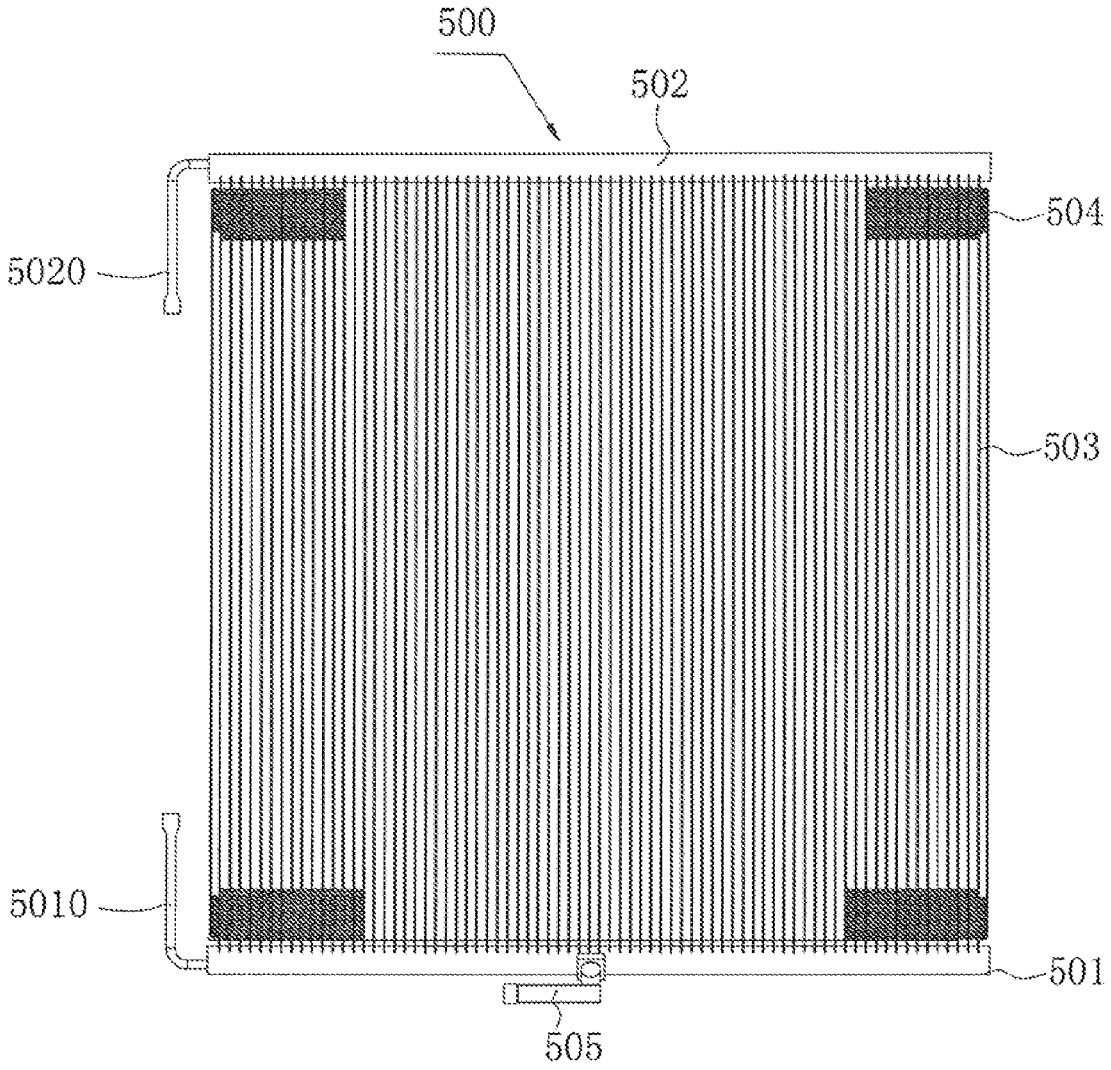
FIG. 3 is a plan view of an evaporator according to another embodiment of the invention.
Figure 4:
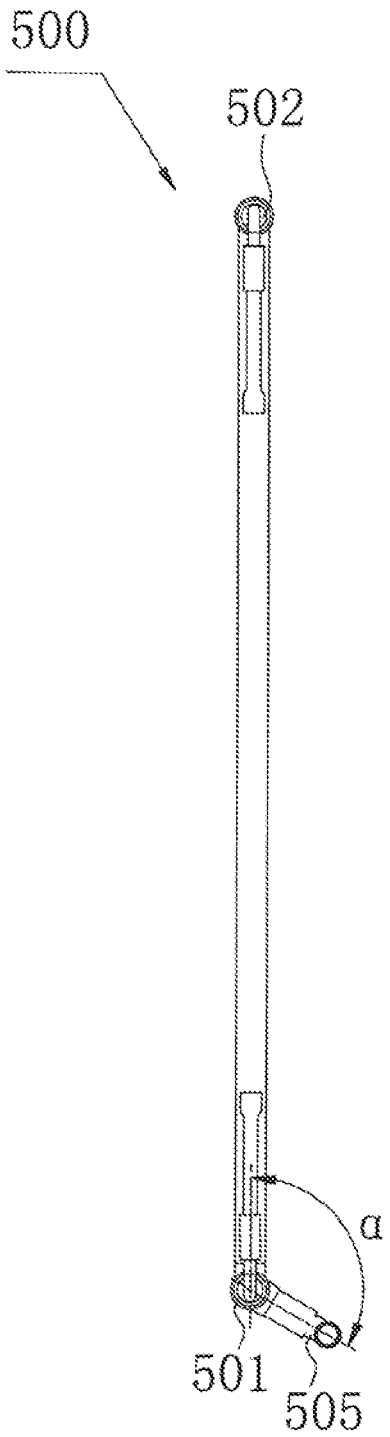
FIG. 4 is a side view of the evaporator shown in FIG. 3.

FIGS. 3-4 show the evaporator 500 according to another embodiment of the invention, wherein the first end of the defrosting tube 505 is connected to the substantially middle portion of the inlet header 501. An angle "$\alpha$" between the axis of the defrosting tube 505 and the axis of each heat-exchange tube is between about 45 degrees and about 315 degrees.

Figure 5:
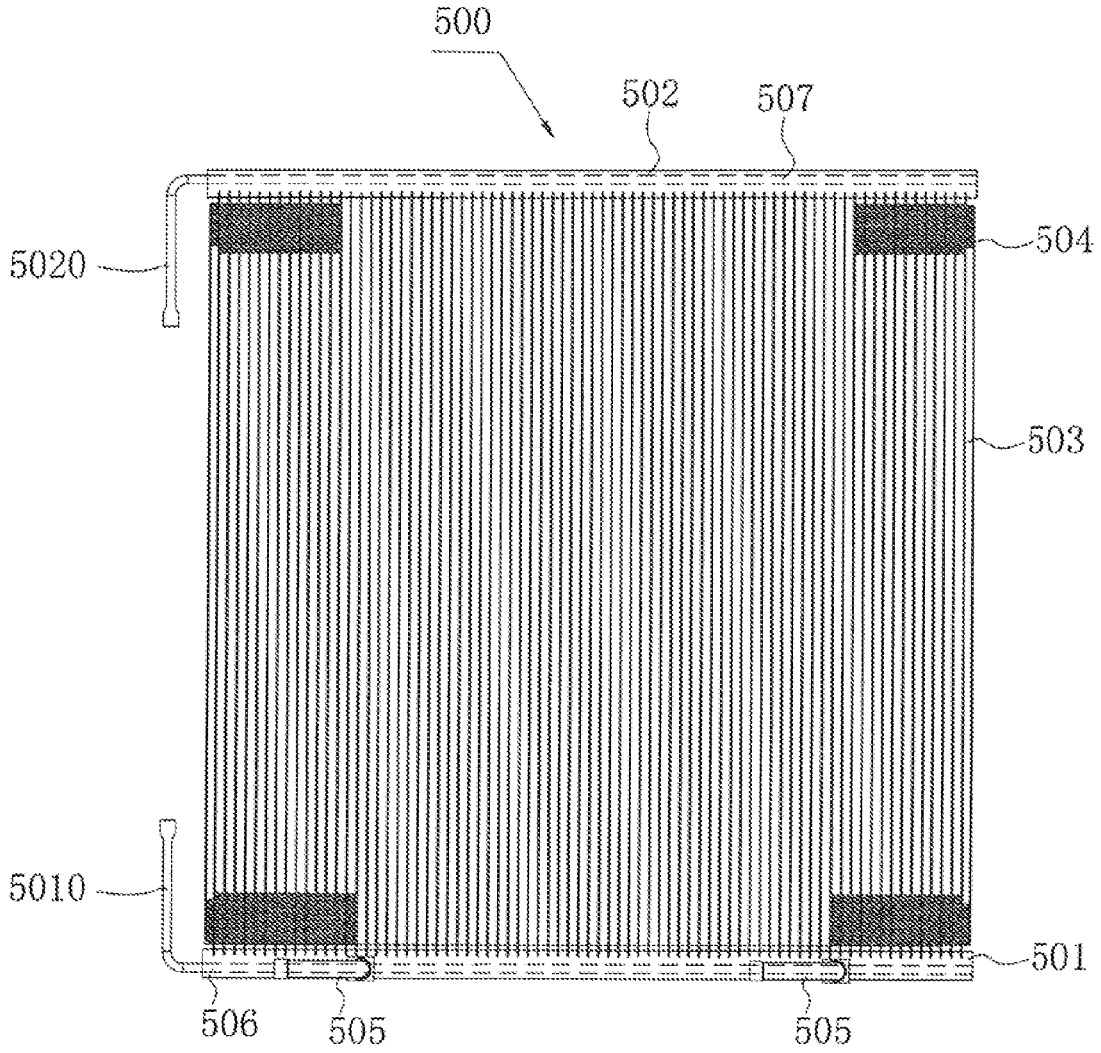
FIG. 5 is a plan view of an evaporator according to yet another embodiment of the invention.
Figure 6:
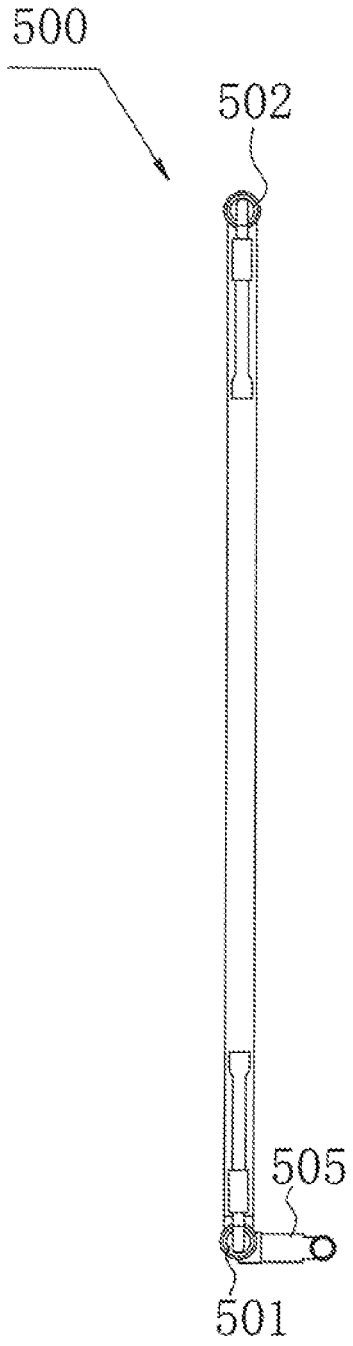
FIG. 6 is a side view of the evaporator shown in FIG. 5.

FIGS. 5-6 show the evaporator 500 according to yet another embodiment of the invention, wherein two defrosting tubes 505 are connected to the inlet header 501, respectively, and spaced apart from each other in the "length" direction of the inlet header 501. Both the distance from the left defrosting tube 505 to the left end of the inlet header 501 and the distance from the right defrosting tube 505 to the right end of the inlet header 501 are greater than about 100 millimeters, thus further improving the defrosting effect. It should be appreciated that the number of the defrosting tubes 505 is not limited to this, and any suitable number of defrosting tubes 505 may be disposed according to particular applications.

In the embodiment shown in FIGS. 5-6, the inlet header 501 is formed with a refrigerant guide tube 506 having an open end and a closed end and with a plurality of openings, such as a plurality of non-circular slots, in a "length" direction of the refrigerant guide tube 506. The open end of the refrigerant guide tube 506 is extended out from the refrigerant inlet of the inlet header 501. More particularly, the open end of the refrigerant guide tube 506 is connected to the refrigerant inlet pipe 5010.

Alternatively, as shown in FIG. 6, a refrigerant guide tube 507 having an open end and a closed end is inserted into the outlet header 502 and formed with a plurality of openings, such as a plurality of non-circular slots, in a "length" direction of the refrigerant guide tube 507. The open end of the refrigerant guide 507 is extended out from the refrigerant outlet of the outlet header 502. More particularly, the open end of the refrigerant guide tube 507 is connected to the refrigerant outlet pipe 5020.

In some embodiments, the defrosting tube 505 may also be connected to the outlet header 502. Similarly, the position of the first end of the defrosting tube 505 connected to the outlet header 502 is spaced apart from the one end of the outlet header 502 (for example, the first end of the defrosting tube 505 is connected to a substantially middle portion of the outlet header 502).

With the evaporator 500 according to embodiments of the invention, because the defrosting tube 505 is connected to the inlet header 501 or the outlet header 502, when the evaporator 500 needs to be defrosted, the refrigerant enters into the inlet header 501 or the outlet header 502 from the defrosting tube 505, thus improving the defrosting speed, shortening the defrosting time, and improving the energy efficiency of the refrigeration system.

The refrigeration system according to embodiments of the invention will be described below with reference to FIG. 7.

The refrigeration system (e.g., a heat-pump system) according to embodiments of the invention comprises a compressor 100, a four-way valve 200, a condenser 300, a throttle mechanism 400, an evaporator 500, and a refrigerant switching unit.

More particularly, the four-way valve 200 has first to fourth valve ports (which are, in FIG. 7, the left valve port, the upper valve port, the right valve port, and the lower valve port, respectively), wherein the first valve port and the third valve port of the four-way valve 200 are connected to the compressor 100. An inlet of the condenser 300 is connected to the second valve port of the four-way valve 200. An inlet of the throttle mechanism 400 (e.g., an expansion valve) is connected to an outlet of the condenser 300. The evaporator 500 is connected between the fourth valve port of the four-way valve 200 and an outlet of the throttle mechanism 400.

The refrigerant switching unit is connected to the evaporator 500, connected between the fourth valve port of the four-way valve 200 and the outlet of the throttle mechanism 400, configured to allow the refrigerant to enter into the inlet header 501 from the four-way valve 200 through the throttle mechanism 400 and flow out of the outlet header 502 to return to the four-way valve 200 when the refrigeration system is in a "normal operation" mode, and configured to allow the refrigerant to enter into the one header from the four-way valve 200 through the defrosting tube 505 and flow out of the other of the inlet and outlet headers 501, 502 to return to the four-way valve 200 through the throttle mechanism 400 when the refrigeration system is in a "defrosting operation" mode.

For example, when the refrigeration system is operated in a "heating" mode, an indoor unit is used as the condenser 300, and a fan "F" is driven by a motor "M" such that the hot air heated by the condenser 300 is blown into a room for heating.

Figure 7:
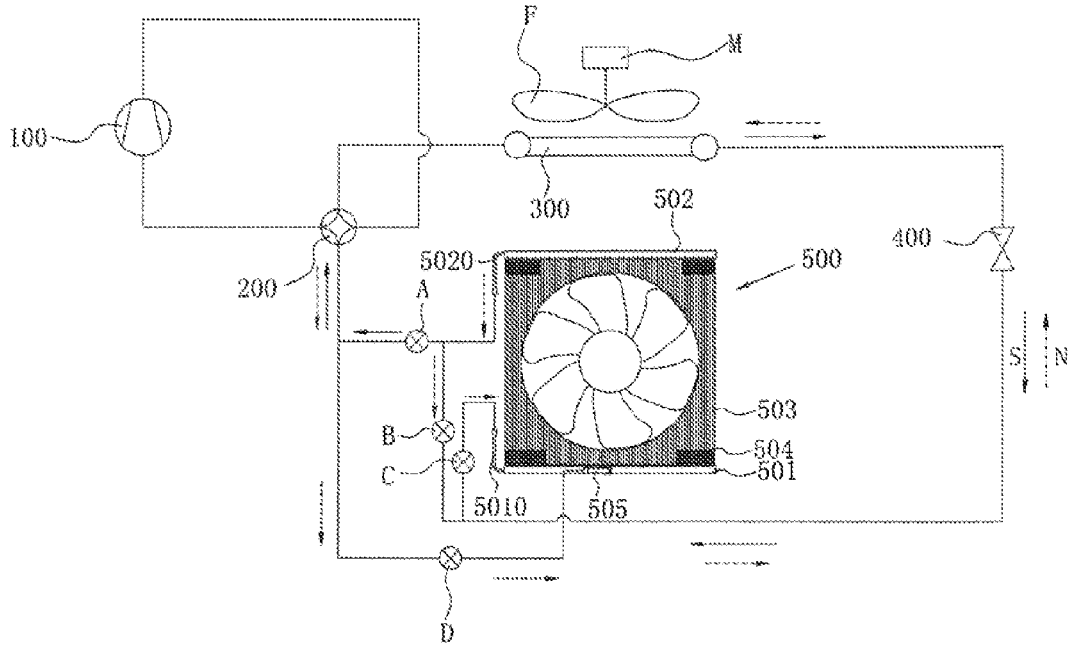
FIG. 7 is a schematic diagram of a refrigeration system according to an embodiment of the invention.

As shown in FIG. 7, the refrigerant switching unit includes a first valve "A," a second valve "B," a third valve "C," and a fourth valve "D." The first valve "A" is connected between the fourth valve port of the four-way valve 200 and the refrigerant outlet 5020 of the outlet header 502, a first side of the second valve "B" is connected between the first valve "A" and the second refrigerant port 5020 of the second header 502, a second side of the second valve "B" is connected to the throttle mechanism 400, a first side of the third valve "C" is connected between the second side of the second valve "B" and the throttle mechanism 400, a second side of the third valve "C" is connected to the refrigerant outlet 5010 of the inlet header 501, a first end of the defrosting tube 505 is connected to a substantially middle portion of the inlet header 501, and the fourth valve "D" is connected between the fourth valve port of the four-way valve 200 and a second end of the defrosting tube 505.

The "normal operation" mode and the "defrosting operation" mode of the refrigeration system according to embodiments of the invention will be described below with reference to FIG. 7.

As shown in FIG. 7, the first end of the defrosting tube 505 is connected to the inlet header 501. When the refrigeration system is operated in the "normal operation" mode, the first valve "A" and the third valve "C" are opened, and the second valve "B" and the fourth valve "D" are closed. Therefore, the refrigerant enters into the four-way valve 200 from the compressor 100 through the third valve port of the four-way valve 200, into the condenser 300 through the second valve port of the four-way valve 200 along the direction shown by solid arrows "S," and then into the throttle mechanism 400 along the direction shown by the solid arrows "S." Because the second valve "B" is closed off and the third valve "C" is opened, the refrigerant enters into the inlet header 501 through the refrigerant inlet pipe 5010 of the inlet header 501 (for example, may be distributed in the inlet header 501 through the refrigerant guide tube 506), thus eliminating gas-liquid separation. The refrigerant enters into each heat-exchange tube 503 from the inlet header 501 and then enters into the outlet header 502 of the evaporator 500 after exchanging heat with the environment. Because the second valve "B" and the fourth valve "D" are closed and the first valve "A" is opened, the refrigerant flowing out of the outlet header 502 (for example, from the refrigerant outlet pipe 5020) is returned to the four-way valve 200 through the first valve "A" and the fourth valve port of the four-way valve 200 and then enters into the compressor 100 from the first valve port of the four-way valve 200. Thus, the circulation of the refrigerant is achieved.

When defrosting is needed, the refrigeration system is switched to operate in the "defrosting operation" mode. At this time, the first valve "A" and the third valve "C" are closed, and the second valve "B" and the fourth valve "D" are opened. The refrigerant enters into the defrosting tube 505 from the fourth valve port of the four-way valve 200 through the fourth valve "D" along the direction shown by dashed arrows "N" and then enters into the inlet header 501 of the evaporator 500 from the defrosting tube 505 (for example, into the inlet header 501 from the substantially middle portion of the inlet header 501), thus defrosting the evaporator 500 with higher defrosting speed.

The refrigerant flows into the outlet header 502 along the plurality of heat-exchange tubes 503 and then flows out from the refrigerant outlet pipe 5020. Because the first valve "A" and the third valve "C" are closed, the refrigerant flowing out of the outlet header 502 may be only returned to the four-way valve 200 through the throttle mechanism 400, the condenser 300, and the third valve port of the four-way valve 200.

Therefore, with the refrigeration system according to embodiments of the invention, when defrosting is needed, the gaseous refrigerant enters into the inlet header 501 from the defrosting tube 505 and bypasses the refrigerant guide tube 506, thus reducing the flow-resistance greatly, increasing the flow rate of the refrigerant, and improving the defrosting speed. On the other hand, for the refrigeration system (e.g., using the refrigerant of R407C) in which most of frosts are accumulated at the refrigerant inlet 5010 of the inlet header 501, the high-temperature gaseous refrigerant enters from the inlet header 501, thus accelerating melting of the frost directly and helping evaporation of melt-water after defrosting. Therefore, by the defrosting tube 505, the defrosting process of the refrigeration system may be greatly accelerated, the defrosting time may be shortened, and the defrosting effect may be enhanced, thus reducing the fluctuation of indoor temperature and improving the comfort degree. Moreover, reverse circulation of the refrigerant in the evaporator 500 may not be required.

The refrigeration system according to another embodiment of the invention will be described below with reference to FIG. 8.

Figure 8:
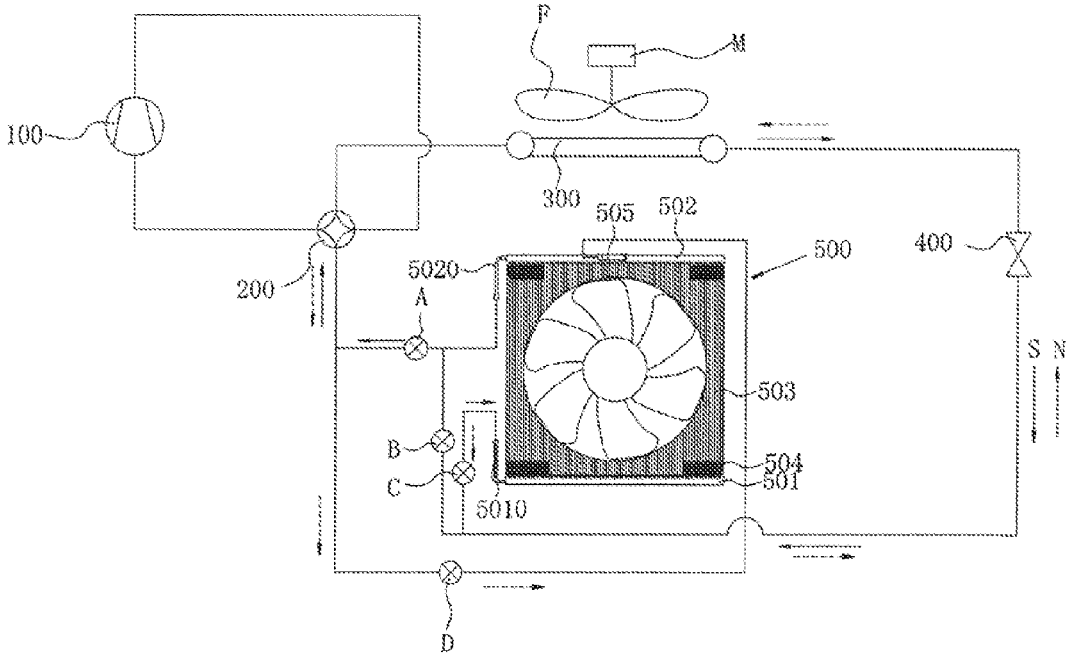
FIG. 8 is a schematic diagram of a refrigeration system according to another embodiment of the invention.

In the embodiment shown in FIG. 8, the first end of the defrosting tube 505 is connected to the outlet header 502. When the refrigeration system is in the "normal operation" mode, the first valve "A" and the third valve "C" are opened, and the second valve "B" and the fourth valve "D" are closed. When the refrigeration system is in the "defrosting operation" mode, the first valve "A" and the second valve "B" are closed, and the third valve "C" and the fourth valve "D" are opened. In other words, in this case, the third valve "C" is normally opened, and the second valve "B" is normally closed. In the "defrosting operation" mode, the refrigerant enters into the outlet header 502 from the defrosting tube 505, into the inlet header 501 through the plurality of heat-exchange tubes 503, and then is returned to the four-way valve 200 through the throttle mechanism 400 and the condenser 300. Other operations of the refrigeration system in the "normal operation" mode and the "defrosting operation" mode will not be described in detail here.

With the refrigeration system shown in FIG. 8, for some cases in which most of frosts are accumulated at the refrigerant outlet 5020 of the outlet header 502, the defrosting tube 505 is connected to the outlet header 502, which may help rapid melting of frost at the upper portion of the evaporator 500.

The refrigeration system according to yet another embodiment of the invention will be described below with reference to FIG. 9.

Figure 9:
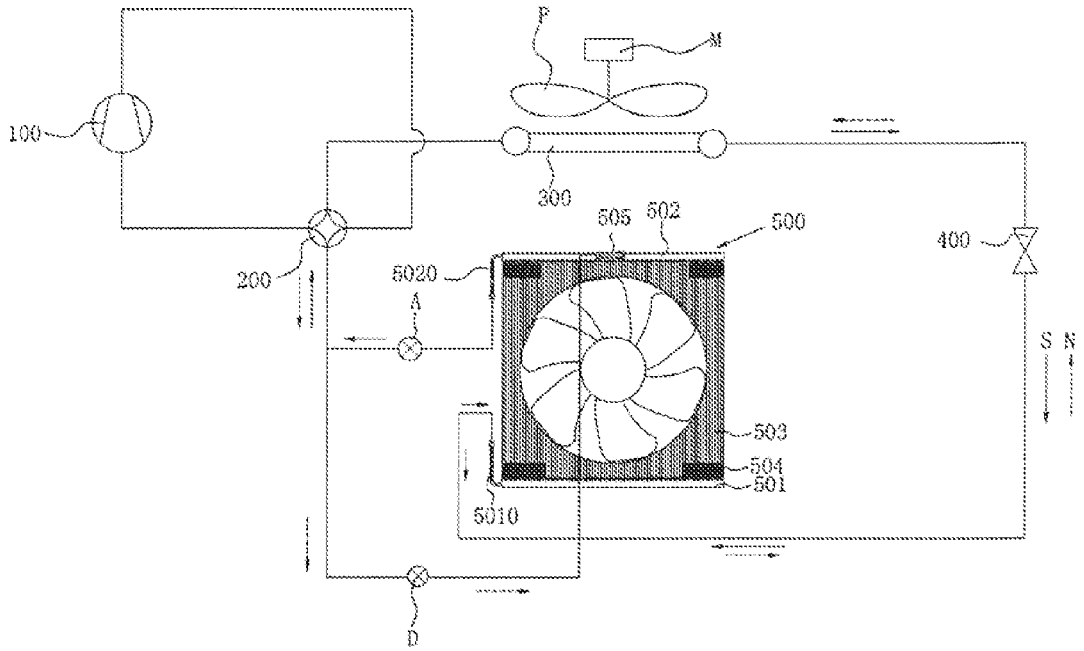
FIG. 9 is a schematic diagram of a refrigeration system according to yet another embodiment of the invention.

In the embodiment shown in FIG. 9, the first end of the defrosting tube 505 is connected to the outlet header 502, and the refrigerant switching unit includes a first valve "A" connected between the fourth valve port of the four-way valve 200 and the refrigerant outlet 5020 of the outlet header 502 and a fourth valve "D" connected between the fourth valve port of the four-way valve 200 and a second end of the defrosting tube 505.

When the refrigeration system is in the "normal operation" mode, the first valve "A" is opened, and the fourth valve "D" is closed. When the refrigeration system is in the "defrosting operation" mode, the first valve "A" is closed, and the fourth valve "D" is opened. The embodiment shown in FIG. 9 is different from the embodiment shown in FIG. 8 in that the normally closed second valve "B" and the normally opened third valve "C" are omitted, a position in which the second valve "B" is located is cut off, and a position in which the third valve "C" is located is replaced by a pipe, thus reducing the cost and the control complexity. The operation of the refrigeration system shown in FIG. 9 is similar to that of the refrigeration system shown in FIG. 8 so that detailed description thereof will be omitted here.

The refrigeration system according to still another embodiment of the invention will be described below with reference to FIG. 10.

Figure 10:
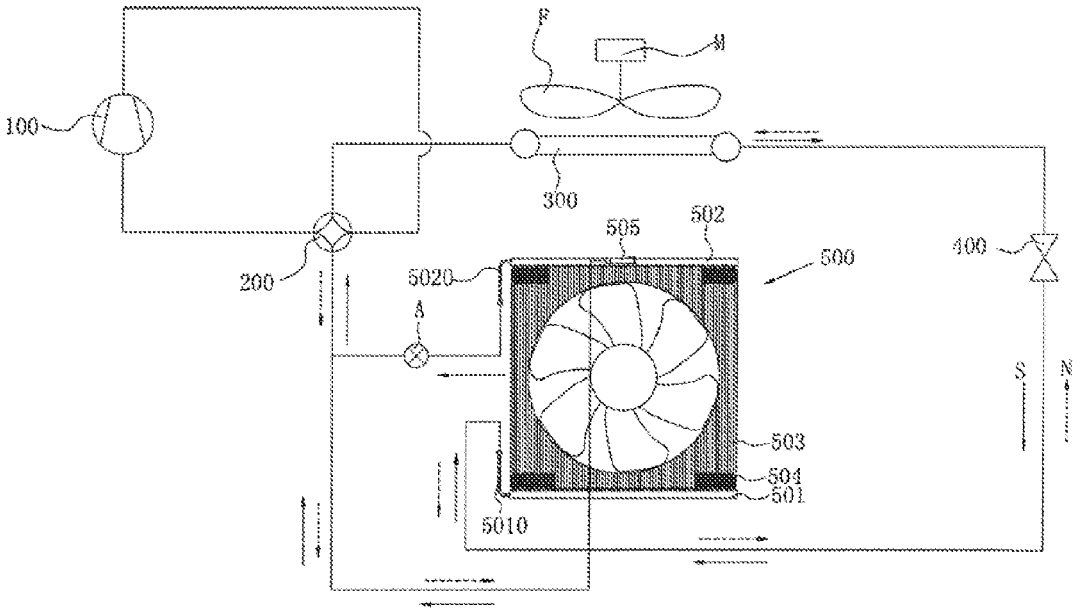
FIG. 10 is a schematic diagram of a refrigeration system according to still another embodiment of the invention.

In the embodiment shown in FIG. 10, the first end of the defrosting tube 505 is connected to the outlet header 502, a second end of the defrosting tube 505 is connected to the fourth valve port of the four-way valve 200, and the refrigerant switching unit includes a first valve "A" connected between the fourth valve port of the four-way valve 200 and the refrigerant outlet 5020 of the outlet header 502.

When the refrigeration system is in the "normal operation" mode, the first valve "A" is opened, and the refrigerant is returned to the four-way valve 200 from the outlet header 502 through the first valve "A." Certainly, a small amount of the refrigerant is returned to the four-way valve 200 from the defrosting tube 505.

When the refrigeration system is in the "defrosting operation" mode, the first valve "A" is closed, and the refrigerant enters into the outlet header 502 from the defrosting tube 505 and then is returned to the four-way valve 200 through the plurality of heat-exchange tubes 503, the inlet header 501, the throttle mechanism 400, and the condenser 300.

Only one valve is used by the refrigeration system shown in FIG. 10 such that the structure is much simpler, the cost is much lower, and the control is much easier.

In the above-described embodiments, the evaporator 500 of the refrigeration system only has one defrosting tube 505. However, it should be noted that any suitable number of the defrosting tube 505 may be disposed according to requirements and the defrosting tubes 505 may be connected to the inlet header 501 and the outlet header 502, respectively. Certainly, the defrosting tubes 505 connected to the inlet header 501 and the outlet header 502, respectively, may have respective refrigerant switching units.

Reference throughout this specification to "an embodiment," "some embodiments," "one embodiment," "an example," "a specific example," or "some examples" means that a particular feature, structure, material, or characteristic described in connection with the embodiment or example is included in at least one embodiment or example of the disclosure. Thus, the appearances of the phrases such as "in some embodiments," "in one embodiment," "in an embodiment," "an example," "a specific example," or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from the spirit and principles of the disclosure. Such changes, alternatives, and modifications all fall into the scope of the claims and their equivalents.

What is claimed is:

1. A refrigeration system comprising:

a compressor;

a four-way valve defining first to fourth valve ports, the first valve port and the third valve port being connected to the compressor;

a condenser defining an inlet connected to the second valve port;

a throttle mechanism defining an inlet connected to an outlet of the condenser;

an evaporator connected between the fourth valve port and an outlet of the throttle mechanism, the evaporator including:

a first header defining one end at which a first refrigerant port is formed;

a second header defining one end at which a second refrigerant port is formed;

a plurality of heat-exchange tubes each of which is connected between the first and second headers to communicate the first and second headers;

a plurality of fins respectively interposed between adjacent ones of the heat-exchange tubes; and a defrosting tube defining a first end and a second end, wherein the first end is connected to one of the first and second headers to communicate with an interior of the one header, a position at which the first end of the defrosting tube is connected to the one of the first and second headers is spaced apart from the one end of the one header by a predetermined distance, and the second end is connected with the fourth valve port of the four-way valve directly or via a valve; and a refrigerant switching unit connected to the evaporator, connected between the fourth valve port and the outlet of the throttle mechanism, allowing a refrigerant to enter into the first header from the four-way valve through the throttle mechanism and flow out of the second header to return to the four-way valve when the refrigeration system is in a "normal operation" mode, and allowing the refrigerant to enter into the one header from the four-way valve through the defrosting tube and flow out of the other of the first and second headers to return to the four-way valve through the throttle mechanism when the refrigeration system is in a "defrosting operation" mode.

2. The refrigeration system according to claim 1, wherein the refrigerant switching unit includes first to fourth valves, the first valve is connected between the fourth valve port of the four-way valve and the second refrigerant port of the second header, a first side of the second valve is connected between the first valve and the second refrigerant port, a second side of the second valve is connected to the throttle mechanism, a first side of the third valve is connected between the second side of the second valve and the throttle mechanism, a second side of the third valve is connected to the first refrigerant port of the first header, and the fourth valve is connected between the fourth valve port and the second end of the defrosting tube.

3. The refrigeration system according to claim 2, wherein the first end of the defrosting tube is connected to either of the first and second headers.

4. The refrigeration system according to claim 1, wherein the first end of the defrosting tube is connected to the second header and the refrigerant switching unit-includes a first valve connected between the fourth valve port of the four-way valve and the second refrigerant port of the second header and a fourth valve connected between the fourth valve port and the second end of the defrosting tube.

5. The refrigeration system according to claim 1, wherein the first end of the defrosting tube is connected to the second header, the second end of the defrosting tube is connected to the fourth valve port of the four-way valve directly, and the refrigerant switching unit includes a first valve connected between the fourth valve port of the four-way valve and the second refrigerant port of the second header.

6. The refrigeration system according to claim 1, wherein the first end of the defrosting tube is connected to a middle portion of the one header.

7. The refrigeration system according to claim 1, wherein an angle between an axis of the defrosting tube and an axis of each of the heat-exchange tubes is between about 45 degrees and about 315 degrees.

8. The refrigeration system according to claim 1, wherein the predetermined distance is greater than about 100 millimeters.

9. The refrigeration system according to claim 1, wherein a refrigerant guide tube is inserted into the one header, defines an open end and a closed end and is formed with a plurality of openings, the open end of the refrigerant guide tube extends out from a refrigerant port of the one header and forms the one of the first and second refrigerant ports.

* * * * *